US008944869B2

(12) United States Patent
Lehmann et al.

(10) Patent No.: US 8,944,869 B2
(45) Date of Patent: Feb. 3, 2015

(54) PRE-NOZZLE FOR A DRIVE SYSTEM OF A WATERCRAFT TO IMPROVE THE ENERGY EFFICIENCY

(75) Inventors: Dirk Lehmann, Winsen/Luhe (DE); Friedrich Mewis, Dresden (DE)

(73) Assignee: becker marine systems GmbH & Co. KG, Hamburg (DE)

( * ) Notice: Subject to any disclaimer, the term of this patent is extended or adjusted under 35 U.S.C. 154(b) by 214 days.

(21) Appl. No.: 13/403,586

(22) Filed: Feb. 23, 2012

(65) Prior Publication Data

US 2013/0059491 A1 Mar. 7, 2013

(30) Foreign Application Priority Data

Feb. 25, 2011 (DE) ..... 20 2011 000 439 U
Jul. 12, 2011 (EP) ..... 11173670

(51) Int. Cl.
*B63H 1/18* (2006.01)
*B63H 5/16* (2006.01)

(52) U.S. Cl.
CPC ..... *B63H 5/16* (2013.01)
USPC ..... 440/66

(58) Field of Classification Search
USPC ..... 440/66
See application file for complete search history.

(56) References Cited

U.S. PATENT DOCUMENTS

| | | | | |
|---|---|---|---|---|
| 4,070,984 | A * | 1/1978 | Kappas | 440/72 |
| 4,428,735 | A * | 1/1984 | Gruzling et al. | 440/76 |
| 4,680,017 | A * | 7/1987 | Eller | 440/66 |
| 4,694,645 | A * | 9/1987 | Flyborg et al. | 60/221 |
| 4,957,459 | A * | 9/1990 | Snyder | 440/72 |
| 5,470,202 | A * | 11/1995 | Lemont | 415/211.1 |
| 5,906,522 | A * | 5/1999 | Hooper | 440/66 |
| 5,928,042 | A * | 7/1999 | Quiggins | 440/72 |
| 6,159,060 | A * | 12/2000 | Purnell et al. | 440/46 |
| 6,572,422 | B2 * | 6/2003 | Kirkwood et al. | 440/67 |
| 8,123,578 | B2 | 2/2012 | Mewis | |
| 8,142,242 | B2 * | 3/2012 | Whitener | 440/38 |
| 8,356,566 | B1 * | 1/2013 | Sellins | 114/166 |
| 2001/0051475 | A1 * | 12/2001 | Reuter et al. | 440/66 |
| 2004/0009718 | A1 * | 1/2004 | Henmi et al. | 440/66 |
| 2006/0099863 | A1 | 5/2006 | Yang | |
| 2006/0166570 | A1 | 7/2006 | Norman | |

FOREIGN PATENT DOCUMENTS

| | | | |
|---|---|---|---|
| CN | 1774365 | A | 5/2006 |
| CN | 101200216 | A | 6/2008 |
| EP | 2100808 | A1 | 9/2009 |
| JP | S58-139395 | U | 9/1983 |
| JP | S58-139396 | U | 9/1983 |
| JP | 62038800 | A1 | 2/1987 |
| JP | 09175488 | A | 7/1997 |
| JP | 2004-130908 | A | 4/2004 |
| JP | 2008-143488 | A | 6/2008 |
| JP | 2009-214874 | A | 9/2009 |
| JP | 2011-042201 | A | 3/2011 |
| KR | 20080055615 | A | 6/2008 |

* cited by examiner

*Primary Examiner* — Lars A Olson
*Assistant Examiner* — Jovon Hayes
(74) *Attorney, Agent, or Firm* — Kelly & Kelley, LLP

(57) ABSTRACT

A drive system for a watercraft has a water inlet opening, a water outlet opening, and a fin system. A propellerless pre-nozzle for the drive system is configured rotationally asymmetrically in order to further improve the drive efficiency.

21 Claims, 3 Drawing Sheets

1 / 3

PRE-NOZZLE FOR A DRIVE SYSTEM OF A WATERCRAFT TO IMPROVE THE ENERGY EFFICIENCY

FIELD OF THE INVENTION

The invention relates to a pre-nozzle for a drive system of a watercraft to improve the energy efficiency.

BACKGROUND OF THE INVENTION

Drive systems for different types of ships to improve the drive power requirements are known from the prior art. Known from EP 2 100 808 A1 is, for example, a drive system for a ship, based on a pre-nozzle. The drive system consists of a propeller and a pre-nozzle which is mounted directly upstream of the propeller and comprises fins or hydrofoils integrated in the pre-nozzle. The pre-nozzle substantially has the shape of a flat conical cut-out, where both openings, both the water inlet and the water outlet opening, are configured as circular openings and the water inlet openings has a larger diameter than the water outlet opening. It is thereby possible to improve the propeller afflux and to reduce the losses on the propeller stream due to pre-swirl generation by means of the fins or hydrofoils integrated in the pre-nozzle.

SUMMARY OF THE INVENTION

It is the object of the present invention to provide a pre-nozzle for a drive system of a watercraft for further improvement of the drive efficiency, in particular for slow, large-volume ships.

Accordingly, the pre-nozzle for a drive system of a watercraft, in particular a ship of the type described initially, is configured in such a manner that a fin system is disposed inside the pre-nozzle. In this case, the pre-nozzle is located upstream of a propeller in the direction of travel of the ship. "In the direction of travel of the ship" is to be understood here as the forward direction of travel of a ship. No propeller is located inside the pre-nozzle as for example, in Kort nozzles. Furthermore, the pre-nozzle is located at a distance from the propeller.

The fin system located inside the pre-nozzle consists of a plurality of, for example, four or five, fins which are arranged radially to the propeller axis and are connected to the inner surface of the nozzle body. In this case, the individual fins are preferably located asymmetrically inside the pre-nozzle. Fins are understood as fins or hydrofoils. The fin system located inside the pre-nozzle therefore consists of a plurality of fins or hydrofoils.

"Inside the pre-nozzle" is to be understood as that region which is enclosed by the nozzle body of a pre-nozzle which is closed conceptually at both openings. Consequently, the individual fins of the fin system are arranged in such a manner that they are located substantially inside the pre-nozzle and preferably are located completely inside the pre-nozzle, i.e. do not project from one or both openings of the pre-nozzle. In contrast to this, the propeller of the ship is arranged in such a manner that it is located substantially outside the pre-nozzle and preferably does not project at any point into the pre-nozzle, i.e. through one of the two openings of the pre-nozzle.

The extension of the individual fins of the fin system in the longitudinal direction of the pre-nozzle is preferably smaller or shorter than the length of the pre-nozzle at its shortest point. Extension is to be understood here as the region or the length along the inner surface of the pre-nozzle over which the fins extend in the longitudinal direction of the pre-nozzle.

Particularly preferably the extension of the individual fins in the longitudinal direction of the pre-nozzle is less than 90%, quite particularly preferably less than 80% or even less than 60% of the length of the pre-nozzle at the shortest point of the pre-nozzle. The longitudinal direction corresponds to the direction of flow. In this case, the individual fins can be set at identical or different angles. This means that the angles of attack of the individual fins can be selected and adjusted differently. The angle of attack corresponds to the angle between a generatrix along the inner surface of the pre-nozzle and the side of the edge of the fin facing the inner surface. Consequently, the fins are set at an angle, the angle of attack, to the flow direction. It is furthermore preferred that the fins are located substantially in the rear area, i.e. in the area facing the propeller. Consequently the inlet area of the pre-nozzle has no fin system and is used only to accelerate the water flow. The fin system located in the rear area of the pre-nozzle or the fin system located following the inlet area is used (additionally) to produce pre-swirl.

Furthermore, the pre-nozzle according to the invention is configured to be rotationally asymmetrical. The axis of rotation of the pre-nozzle is thereby located along the pre-nozzle in such a manner that, when the pre-nozzle is viewed in cross-section, it lies both in vertical and horizontal alignment at the centre and preferably runs through the centre of the water outlet opening. Due to the rotationally asymmetric configuration of the pre-nozzle, the pre-nozzle is therefore not mapped onto itself during rotation by any arbitrary angle about the axis of rotation. It is thereby possible that individual surface segments, for example, a section in the area of the water outlet opening have per se rotationally asymmetric properties but the pre-nozzle as an entire unit is not a body of rotation. The rotational asymmetry further does not relate to the fin system located inside the pre-nozzle. The pre-nozzle is therefore rotationally asymmetric regardless of the arrangement of the individual fins.

The propeller which is located downstream of the pre-nozzle and at a distance therefrom, is fixed, i.e. is rotatable but not (horizontally or vertically) pivotable about the propeller axis and is rotatably mounted in a stern tube. The pre-nozzle can in this case be located with upwardly displaced axis of rotation lying above the propeller axis. The centre of gravity of the pre-nozzle therefore lies outside the propeller axis. The pre-nozzle can thereby be arranged in such a manner that its axis of rotation runs parallel to the propeller axis or runs at an angle to the propeller axis and therefore is placed obliquely in relation to the propeller axis.

The pre-nozzle is aligned centrally in the horizontal direction in relation to the propeller axis. The axis of rotation of the pre-nozzle and the propeller axis therefore lie in one vertical plane.

Nozzles are known from the prior art which are divided into two halves by an approximately vertical plane, where both halves are arranged offset with respect to one another in the longitudinal direction along the vertical plane. The pre-nozzle according to the invention does not consist of two or more halves offset in the longitudinal direction. The water outlet opening area therefore preferably extends over only one plane and in particular not over planes which are offset with respect to one another.

The pre-nozzle is preferably configured to be closed in its circumference. For example, the pre-nozzle can be configured in one piece and closed over the entire circumference. Furthermore, the pre-nozzle can be composed of two or more parts, where the pre-nozzle is closed over the entire circumference in the assembled state. In this case, parts of the hull, for example, the stern tube can also serve to close the pre-nozzle circumferentially.

Due to the pre-nozzle according to the invention, it is therefore possible to further improve the drive efficiency of a ship whereby the propeller afflux is improved by the configuration of the pre-nozzle and the losses in the propeller jet are reduced by the fin system disposed in the pre-nozzle due to the generation of pre-swirl. In particular, as a result of the rotationally asymmetrical configuration of the pre-nozzle, it is possible to take into account areas of the unfavourable wake and therefore further improve the propeller afflux.

In particular in the case of large, fully laden shops such as, for example, tankers, bulk carriers or tugs, the water velocity in the rear area of the ship, that is in the area of the propeller and the pre-nozzle, is different as a result of the shape of the ship or the configuration of the hull. For example, it is possible that the water velocity in the lower area of the pre-nozzle and the propeller is faster than in the upper area of the pre-nozzle or the propeller. This is particularly because the water inflow velocity in the direction of the pre-nozzle and propeller is more severely retarded or deflected by the hull in the upper region than in the lower region. Due to the rotationally asymmetrical configuration of the pre-nozzle, it is possible to take into account the special ship's shape or the associated influencing of the water inflow velocities and therefore to accelerate the water inflow velocity in particular in the areas of unfavourable wake, for example, in the upper area of the pre-nozzle or the propeller, more strongly by the pre-nozzle than in the area of the more favourable wake, for example, in the lower area of the pre-nozzle or the propeller. The propeller inflow velocity of the water is thereby more uniformly distributed. Consequently, areas with different wake, in particular a different wake ratio in the upper and lower area of the pre-nozzle in relation to the particular flow velocity, are taken into account by the pre-nozzle according to the invention.

A further advantage is that eddy generation can be avoided or reduced by the pre-nozzle according to the invention. This means that the water flow deflected by the hull does not appear or only appears to a small extent at outer surfaces of the nozzle body and therefore no or only a few water vortices are generated. Overall the propulsion efficiency can thus be increased. With the pre-nozzle according to the invention and in particular as a result of the arrangement of the pre-nozzle, the flow is favourably influenced without thereby producing a high resistance or strong vortices. As a result, the propeller thrust can be increased for the same drive power by the apparatus according to the invention or alternatively power and therefore energy can be saved at lower drive power without reducing the propeller thrust.

Compared with a circular opening of a rotationally symmetrical pre-nozzle, the water inlet opening is preferably expanded downwards and/or upwards. The directions upwards and downwards relate here to the built-in state of the pre-nozzle on a ship. Depending on the area of the unfavourable wake or depending on the hull, the water inlet opening of the pre-nozzle according to the invention is expanded upwards or downwards. It is also possible that the water inlet opening of the pre-nozzle is expanded upwards and downwards. Due to the expansion of the water inlet opening, a larger amount of water can flow into the water inlet opening of the pre-nozzle, whereby losses due to the water flow deflected by the hull which in part reach the outer area of the nozzle body in the case of a non-expanded water inlet opening, are reduced. The efficiency is increased due to an improved inflow.

It is furthermore preferred that at least one of the two opening areas, water inlet opening area or water outlet opening area, has a greater length in the vertical direction than in the horizontal direction. Opening areas of the pre-nozzle are to be understood in each case as the surfaces enclosed by the front-end edges of the nozzle body of the pre-nozzle. The nozzle body is typically formed by the so-called "nozzle ring". The nozzle body comprises the so-called sheathing of the pre-nozzle, where the nozzle body consists of an inner surface and an outer surface. The two surfaces are usually spaced apart from one another. The fin system is not part of the nozzle body but is connected to this at the inner surface of the nozzle body. The opening area can be formed over one or over several flat or curved planes. The length in the vertical direction is to be understood as the length of the opening area when viewed from top to bottom along its vertical central line. The greatest length in the horizontal direction is therefore to be understood similarly to the vertical direction as the width of the opening area in the area of its greatest expansion. An elliptical opening area for example has its greatest length in the horizontal direction in the area of its horizontal central line and its greatest length in the vertical direction in the area of its vertical central line. The two opening areas, the inlet opening area and the outlet opening area, can thereby be formed parallel to one another, partially parallel to one another and non-parallel to one another. The lengths in the vertical and horizontal direction in this case always run on the opening area and are therefore not necessarily direct connections of the upper front-side edge of the nozzle body with the lower edge of the nozzle body. If the opening area is formed over several planes, at least one of the two lengths has a bend and/or a curve profile.

The water-inlet-side opening area of the pre-nozzle is preferably greater than a water-inlet-side opening area of a rotationally symmetrical pre-nozzle having the same central radius. Central radius is to be understood as the radius of the pre-nozzle of the upper nozzle body arc when the pre-nozzle is viewed in cross-section in the area of the profile centre of the pre-nozzle. Thus, the central radius is the radius of the upper circular arc which would be visible in a cross-section in the middle of the pre-nozzle relative to the length of the pre-nozzle.

It is further preferred that the pre-nozzle encloses the propeller axis of the ship, at least in certain areas. The pre-nozzle is advantageously arranged in such a manner that its axis of rotation lies above the propeller axis but still encloses the propeller axis with its lower nozzle body segment. Alternatively the lower nozzle body segment can also lie on the propeller axis.

It is further preferred that the inlet opening area of the pre-nozzle is not arranged parallel or only parallel in certain areas to the water outlet opening area of the pre-nozzle. For example, the water outlet opening area of the pre-nozzle could be (completely) parallel to the cross-section of the pre-nozzle or parallel to the perpendicular of the axis of rotation and the water inlet opening area can be inclined with respect to the cross-sectional area of the pre-nozzle or the perpendicular of the axis of rotation of the pre-nozzle or have an angle (at least in certain areas).

The pre-nozzle preferably has a greater profile length in the upper region than in the lower region. The profile length runs along the outer lateral surface of the pre-nozzle and therefore along a generatrix of the nozzle body. Consequently, the profile length is not constant and decreases when viewed from top to bottom. The profile length can decrease in a step-like manner or abruptly, linearly or following any other function from top to bottom. It is furthermore possible that the profile length remains constant, for example, in the upper area of the pre-nozzle and only decreases in the lower region. It is further preferred that the profile length of the pre-nozzle in the area of the axis of rotation is greater than in the lower region of the pre-nozzle.

Consequently, the flow-through length when viewed from top to bottom is not constant within the pre-nozzle or is longer in the upper region of the pre-nozzle than in the lower region of the pre-nozzle. As a result, and in particular as a result of the narrowing of the cross-section of the pre-nozzle and the setting to the flow direction, the water velocity in the upper region of the pre-nozzle is accelerated more strongly or over a longer acceleration distance than in the lower region of the pre-nozzle. Thus, as a result of the pre-nozzle, the water velocity in the area of the unfavourable wake, in the upper inlet region of the pre-nozzle, can be accelerated more strongly than the water already inflowing at higher velocity in the lower region of the pre-nozzle. Consequently, the water outlet velocity and therefore the propeller inflow velocity is more equalised in the upper and lower region or the velocity difference is relatively small. Furthermore, the reduction in the profile length when viewed from top to bottom corresponds to an expansion of the water inlet opening area downwards since in the lower region more water which would have flowed in part from outside onto the jacket of the pre-nozzle with constant profile length of the pre-nozzle is therefore now captured by the opening and can flow into the pre-nozzle.

Preferably the water inlet opening area of the pre-nozzle is provided in such a manner that it has at least one angle of intersection to the cross-sectional area of the pre-nozzle or to the perpendicular to the axis of rotation of the pre-nozzle. Here angle of intersection is to be understood as that angle which is obtained by a conceptual lengthening of the water inlet opening area and the cross-sectional area of the pre-nozzle in the area of the point of intersection of the two interfaces. The angle of intersection thus corresponds to the angle between water inlet opening area and the perpendicular on the pre-nozzle axis or the axis of rotation of the pre-nozzle. Since the water inlet opening area can be formed over several planes, the water inlet opening area and cross-sectional area can therefore have a plurality of, for example, two angles of intersection with respect to one another. Preferably the angle of intersection is less than or equal to 90°, particularly preferably less than 60° and quite particularly preferably less than 30°.

Preferably the angle of intersection between the water-inlet-side opening area and the cross-sectional area of the pre-nozzle is constant at least in one area. This region thereby comprises at least 1%, preferably at least 5% and particularly preferably at least 20% relative to the height of the pre-nozzle in the area of the water outlet opening. Furthermore, the angle of intersection is greater than 0° at least in this region. For example, the angle of intersection could be constant from top to bottom over the entire height of the pre-nozzle. It is further provided that the angle of intersection is only constant in one region, for example, the lower half of the height of the pre-nozzle, i.e. below the axis of rotation. Since the height of the pre-nozzle must not be constant, the height of the pre-nozzle in the area of the water outlet opening is used as reference.

It is further preferred that the opening angle of the pre-nozzle is greater than twice the upper profile angle or greater than twice the lower profile angle. In this case, the opening angle of the pre-nozzle is the angle between upper and lower profile line of the pre-nozzle. The profile line is the generatrix in the longitudinal direction of the pre-nozzle along the outer surface of the pre-nozzle body. In this case, the upper profile line runs along the highest region of the pre-nozzle and the lower profile line runs along the lowest region of the pre-nozzle. The upper profile line therefore has the same length as the profile length in the uppermost region of the pre-nozzle. The lower profile line corresponds to the length of the profile length in the lowermost region of the pre-nozzle. The upper profile angle corresponds to the angle between the (conceptually lengthened) upper profile line and the (conceptually lengthened) axis of rotation of the pre-nozzle. The lower profile angle therefore corresponds to the angle between the (conceptually lengthened) axis of rotation and the (conceptually lengthened) lower profile line. The opening angle of the pre-nozzle therefore corresponds to the sum of the upper profile angle and the lower profile angle.

The opening angle is preferably greater than twice the upper profile angle and the lower profile angle is therefore greater than the upper profile angle.

It is also preferable that the opening angle of the pre-nozzle corresponds to the sum of twice the profile angle and the angle of intersection. Consequently, the lower profile angle corresponds to the sum of the angle of intersection and the upper profile angle. As a result, the opening of the pre-nozzle is expanded, when viewed downwards, by the angle of intersection, i.e. the angle between cross-sectional area and water inlet opening area.

The water inlet opening area of the pre-nozzle is preferably bent or curved. In this case, the water inlet opening area can be curved with a constant radius of curvature when viewed from top to bottom or can have different or several radii of curvature. Furthermore, the water inlet opening area can have one bend or several bends when viewed from top to bottom. As a result, the water inlet opening area is formed over several planes which are preferably at an angle to one another. Particularly preferably the water inlet opening area has a bend and is therefore formed over two planes. In this case, both planes are at an angle to one another which is greater than 90° and less than 180°.

It is further preferred that the profile length of the pre-nozzle between upper and lower profile line of the pre-nozzle decreases continuously from top to bottom. Continuously should be understood here as uninterruptedly. This means that the profile length decreases continuously when viewed from top to bottom. Consequently, when viewed from top to bottom, the profile length does not increase in any region but either remains constant within a region and decreases within the next region or decreases uninterruptedly when viewed from top to bottom. In this case, the profile length can decrease linearly but also following a different function from top to bottom. For example, the profile length could decrease in an arcuate profile when viewed from top to bottom. It is particularly preferred that the profile length decreases linearly from top to bottom over the entire area, i.e. between upper and lower profile line of the pre-nozzle and therefore the value of the angle of intersection is constant. Consequently, the value of the angle of intersection is constant at any position between upper and lower profile line of the pre-nozzle.

In a further embodiment it is provided that the profile length of the pre-nozzle is constant in each area of the pre-nozzle. Consequently water inlet opening area and water outlet opening area are disposed parallel to one another.

Preferably the pre-nozzle or the jacket of the pre-nozzle when viewed in cross-section comprises rectilinear sections. In particular, the pre-nozzle body comprises rectilinear sections when viewed in cross-section over the entire length of the pre-nozzle. At the same time it is preferred that the rectilinear sections in a cross-sectional view interconnect a plurality of arcuate sections. For example, when viewed in cross-section, the pre-nozzle body could consist of an upper and a lower arcuate section or arc segment where both arcuate sections are interconnected by rectilinear sections. Preferably two rectilinear sections are disposed in the side area of the pre-nozzle and in particular opposite one another. As a result, the rectilinear sections when viewed in cross-section are located at the height of the horizontal central line or along the pre-nozzle at the height of the axis of rotation. The arcuate sections could in this case, for example, be semicircles. Furthermore, other forms such as, for example elliptical sections, are feasible. The rectilinear sections preferably have a rectangular cross-section. Consequently the rectilinear sections are used to lengthen the pre-nozzle opening areas in the vertical or horizontal direction. Preferably the two opening areas of the pre-nozzle are expanded by the rectilinear sections in the vertical direction, where the pre-nozzle therefore has a greater height than width. Another possible alternative embodiment consists in the formation of the entire nozzle body with an elliptical cross-section.

It is furthermore preferred that at least one pre-nozzle opening area (inlet opening area or outlet opening area) has the greatest length between upper and lower profile line which is in a ratio between 1.5:1 and 4:1 to the average profile length of the pre-nozzle. Particularly preferred is a ratio between 1.75:1 and 3:1 or between 1.75:1 and 2.5:1, or a ratio in the range of 2:1. Average profile length of the pre-nozzle should be understood as an average profile length of the pre-nozzle.

The invention is now explained with reference to the accompanying drawings using particularly preferred embodiments as an example.

DETAILED DESCRIPTION OF THE PREFERRED EMBODIMENTS

Figures 1, 2, 3:
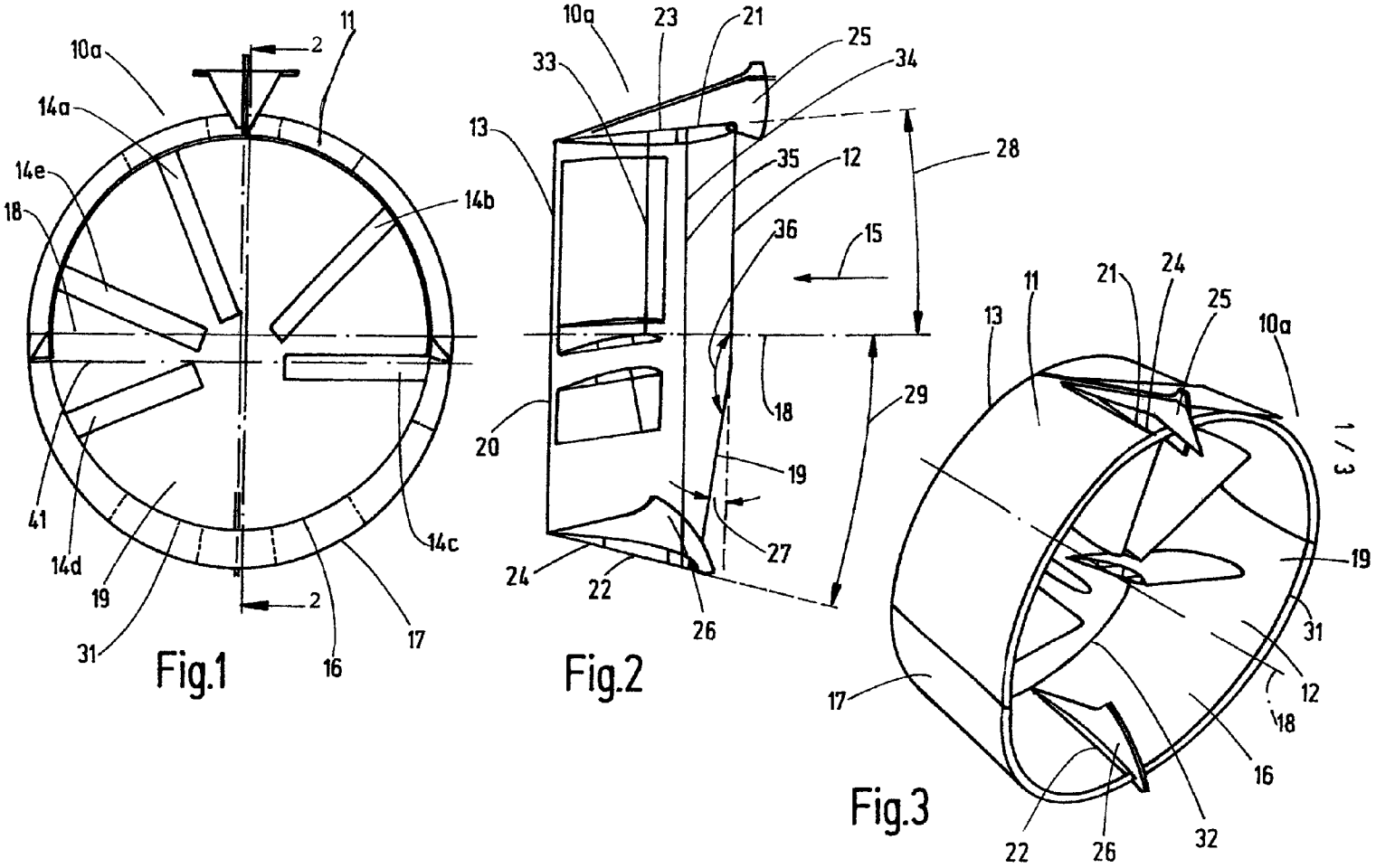
FIG. 1 shows a rotationally asymmetric pre-nozzle in a view from the front or a plan view of the water inlet opening of the pre-nozzle.
FIG. 2 shows a longitudinal sectional view of the rotationally asymmetric pre-nozzle taken along line 2-2 of FIG. 1.
FIG. 3 shows a perspective view of a rotationally asymmetric pre-nozzle according to FIG. 1.

FIGS. 1 to 3 show a pre-nozzle 10*a* having a fin system 14 disposed inside the pre-nozzle 10*a*. The fin system 14 here consists of five individual fins 14*a*, 14*b*, 14*c*, 14*d*, 14*e* which are located radially inside the pre-nozzle 10*a* and asymmetrically over the circumference. It would also be possible to use more or less than five fins. The height of the pre-nozzle in the area of the water outlet opening 13 is smaller than the propeller diameter. The height of the pre-nozzle in the area of the water outlet opening 13 is preferably a maximum of 90%, particularly preferably a maximum of 80% or even a maximum of 65% of the propeller diameter.

As shown in FIG. 1, the pre-nozzle 10*a* is arranged shifted upwards in relation to the propeller axis 41 of the ship. Consequently, the axis of rotation 18 of the pre-nozzle 10*a* and the propeller axis 41 do not coincide with one another. This has the advantage that particularly in large fully laden ships in which the region of unfavourable wake usually lines in the upper propeller inflow region, the water inflow velocity here is more intensified by the pre-nozzle effect than in the lower propeller inflow region, The water inflow direction 15 indicates the inflow direction of the water in the direction of the pre-nozzle 10*a* and therefore also the direction opposite the forward travel of the ship.

FIGS. 2 and 3 further show that the water-inlet-side opening 12 of the pre-nozzle 10*a* is expanded downwards. In the upper region of the pre-nozzle 10*a*, above the axis of rotation 18 of the pre-nozzle 10*a*, the opening areas 19, 20 enclosed by the front-side edges 31, 32 are parallel to one another. In the lower region of the pre-nozzle 10*a*, the water-inlet side pre-nozzle opening 12 is slanted when viewed from top to bottom. Consequently, the water inlet opening area 19 enclosed by the front-side edge 31 of the nozzle body 11 of the pre-nozzle 10*a* is formed over two planes 19*a*, 19*b*. These two planes are at angle 36 to one another, which is greater than 90° and less than 180°.

Furthermore, the downwardly slanting water inlet opening area 19 forms an angle of intersection 27 to the cross-sectional area 34 of the pre-nozzle 10*a* in the area of the bend 42 or to the conceptually parallel-displaced cross-sectional area 34 of the pre-nozzle 10*a*.

Furthermore, the pre-nozzle 10*a* therefore has a shorter profile length 22 in the lower region than in the upper region. In particular, the profile length 21, 22 when viewed from top to bottom is constant as far as the region of the bend 42. In the further course the profile length 21, 22 decreases linearly between bend 42 and the lower profile length 24 when viewed from top to bottom.

It is apparent in particular from FIG. 2 that the opening angle 30 of the pre-nozzle 10*a* which is formed by the upper and lower profile line 23, 24 of the pre-nozzle 10*a* is greater than twice the upper profile angle 28 which is formed by the two legs, upper profile line 23 and axis of rotation 18 of the pre-nozzle 10*a*. Similarly to the upper profile angle 28, the lower profile angle 29 is formed by the two legs, axis of rotation 18 of the pre-nozzle 10*a* and lower profile line 24. It is apparent from FIG. 2 that the lower profile angle 29 corresponds to the sum of the angle of intersection 27 and the upper profile angle 28, with the result that an opening angle 30 enlarged towards the bottom is obtained which corresponds to the sum of twice the upper profile angle 28 and the angle of intersection 27. Consequently, the pre-nozzle opening area 19 is enlarged compared with an opening of a pre-nozzle having circular opening areas disposed parallel to one another and in particular is enlarged towards the bottom.

A further feature of the water inlet opening area 19 is that the opening 12 has an elliptical shape when viewed from the front due to its slant in the lower region. The length of the water-inlet-side pre-nozzle opening area 19 is furthermore longer in the vertical direction, that is viewed from upper profile line 23 to the lower profile line 24, than in the horizontal direction. In this case the length in the vertical direction runs over the two planes of the water inlet opening area 19 or along the opening area. The upper and lower profile lines 23, 24 of the pre-nozzle 10*a* correspond to the generatrices in the uppermost or in the lowermost region of the pre-nozzle 10*a*.

FIGS. 2 and 3 further show two brackets 25, 26, where one bracket 25 is located in the upper region of the pre-nozzle 10*a* and the other bracket 26 is located in the lower region of the pre-nozzle 10*a*. The two brackets 25, 26 are used to mount or fasten the pre-nozzle 10*a* to the hull. Depending on the type of ship, the number of brackets 25, 26 can vary. It is furthermore possible to mount the brackets 25, 26 differently, for example, in the side region of the nozzle body 11. The upper bracket 25 is located substantially outside on the pre-nozzle 10*a* and the lower bracket 26 is located substantially inside on the pre-nozzle 10*a*, where sections of both brackets 25, 26 project towards the front beyond the pre-nozzle 10*a*.

Since the lower profile length 22 of the pre-nozzle 10*a* is shorter than the upper profile length 23 of the pre-nozzle 10*a*, the effect of the pre-nozzle 10*a* and the associated acceleration of the water flow in the upper region are greater than in the lower region. The acceleration section inside the pre-nozzle 10*a* is therefore shorter in the lower region than in the upper region. It is thereby achieved that the water flow in the upper region, that is in the area of the unfavourable wake, is accelerated more strongly than in the lower region. Consequently, not only is the region of unfavourable wake more strongly favoured or the water flow more strongly accelerated by the pre-nozzle 10*a* displaced upwards in relation to the propeller axis 41 of the ship but in addition, due to the decreasing profile length 21, 22 of the pre-nozzle 10*a* from top to bottom, a better compensation of the water velocities between upper and lower region takes place.

Figures 4, 5, 6:
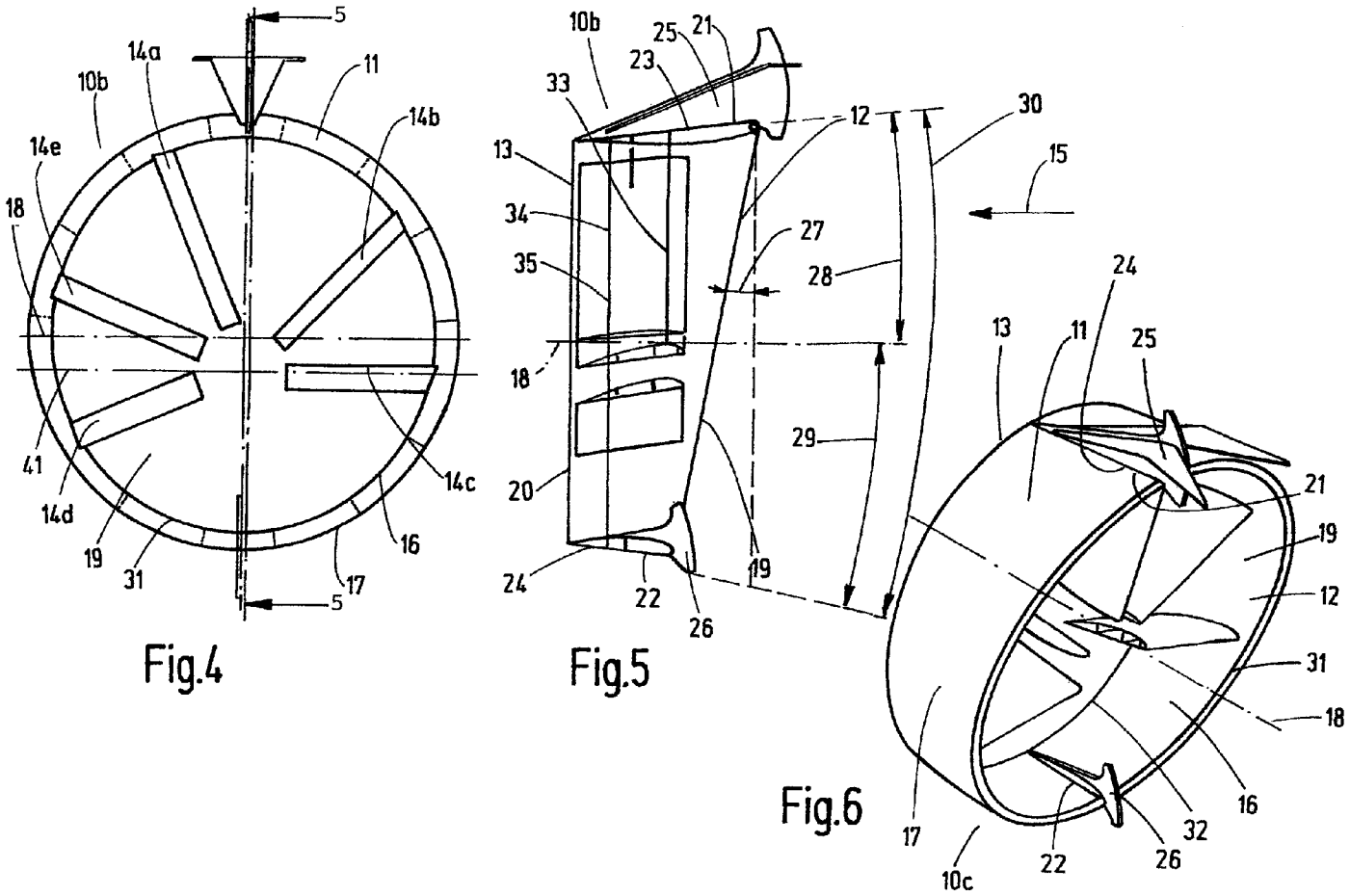
FIG. 4 shows another rotationally asymmetric pre-nozzle in a view from the front or plan view of the pre-nozzle inlet opening.
FIG. 5 shows a longitudinal section view of the pre-nozzle taken along line 5-5 of FIG. 4 with linearly decreasing profile length when viewed from top to bottom in the area of the water inlet opening.
FIG. 6 shows a perspective view of a pre-nozzle according to FIG. 4 with linearly decreasing profile length when viewed from top to bottom.

FIGS. 4 to 6 also show a pre-nozzle 10*b* having an expanded water inlet opening 10. As in the pre-nozzle 10*a* according to FIGS. 1 to 3, the pre-nozzle 10*b* shown in FIGS. 4 to 6 also has a longer profile length 21 in the upper area of the pre-nozzle 10*b* than in the lower region of the pre-nozzle 10*b*. For this purpose the water inlet opening 12 is slanted when viewed from top to bottom. In contrast to the pre-nozzle 10*a*, the water inlet opening area 19 is only formed over one plane where this plane is not completely parallel to the cross-sectional area 34 of the pre-nozzle 10*b* or to the water outlet surface 20 of the pre-nozzle 10*b* due to the slant.

Since the profile length 21, 22 decreases linearly over the entire height of the pre-nozzle 10*b* when viewed from top to bottom, the angle of intersection 27 between water inlet opening area 19 and cross-sectional area 34 or perpendicular of the axis of rotation 35 is constant in the entire region, that is over the entire height of the pre-nozzle 10*b*. The opening angle 30 of the pre-nozzle 10*b* therefore corresponds to the sum of the upper and the lower profile angle 28, 29, where both profile angles 28, 29 of the pre-nozzle 10*b* are the same size. Due to the slant when viewed from top to bottom, an elliptical opening shape is also obtained in plan view of the pre-nozzle 10*b* from the front. The length of the water inlet opening area 19 in the vertical direction, that is when viewed from top to bottom, between upper and lower profile line 23, 24, is therefore also longer than the width or length in the horizontal direction of the water inlet opening area 19. The lengths thereby each run on or along the opening area.

Figures 7, 8, 9:
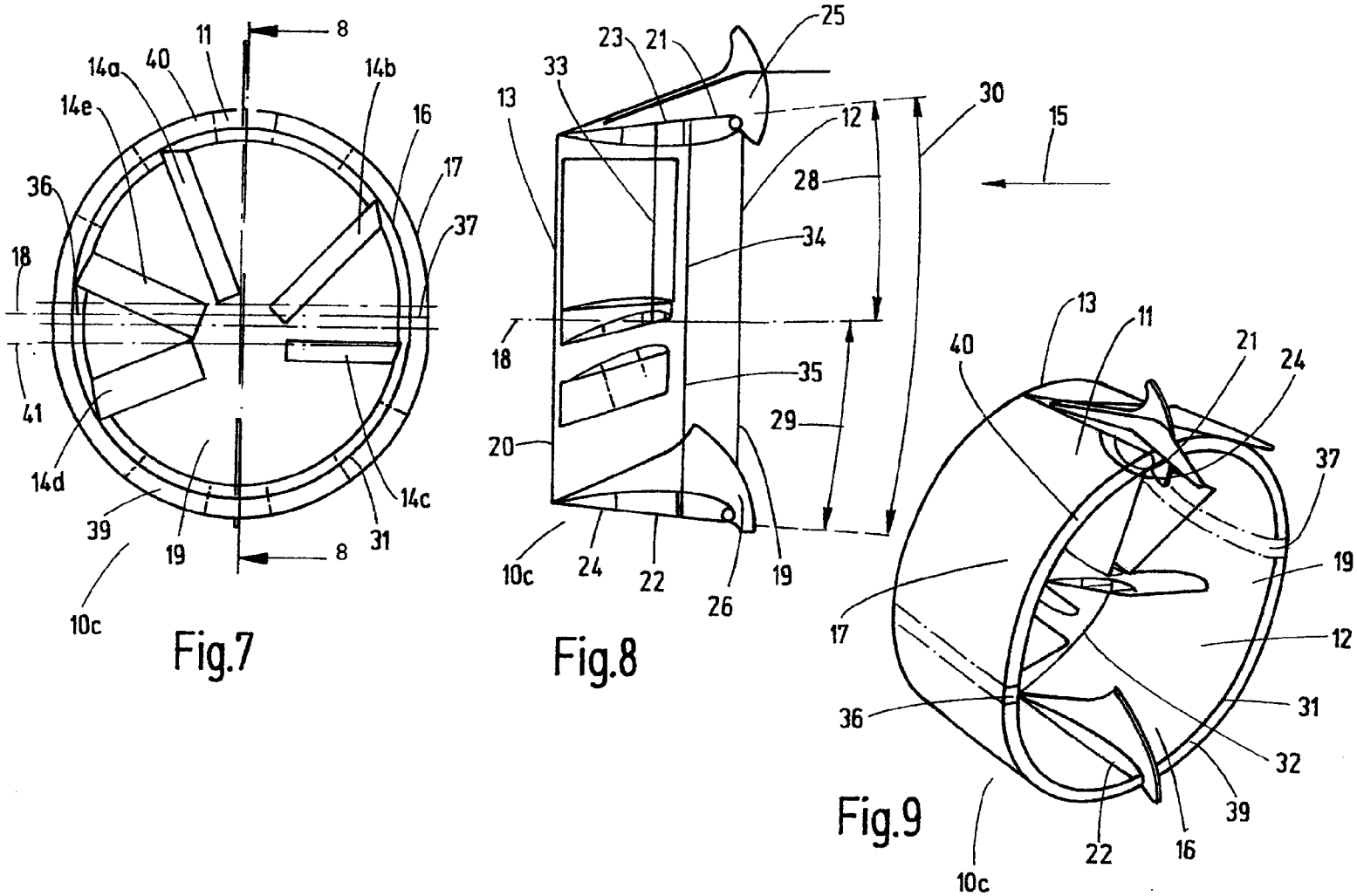
FIG. 7 shows a rotationally asymmetric pre-nozzle with linearly decreasing profile length when viewed from top to bottom with constant profile length in a view from the front or plan view of the water inlet opening.
FIG. 8 shows a longitudinal sectional view of the rotationally asymmetric pre-nozzle taken along line 8-8 of FIG. 7 with constant profile length and FIG. 9 shows a perspective view of a rotationally asymmetric pre-nozzle according to FIG. 7 with constant profile length.

FIGS. 7 to 9 show a pre-nozzle 10*c* having two parallel opening areas 19, 20. In contrast to the pre-nozzles 10*a* and 10*b*, the pre-nozzle 10*c* has a constant profile length 21, 22. The opening angle 30 therefore corresponds to the sum of lower and upper profile angle 28, 29, where lower and upper profile angles 28, 29 are the same. An angle of intersection 27 between water inlet opening area 19 and cross-sectional area 34 of the pre-nozzle 10*c* is not formed here or is 0°.

The nozzle body 11 of the pre-nozzle 10*c* substantially consists of four segments, two arcuate segments 39, 40 and two rectilinear segments 37, 38. The two rectilinear segments 37, 38 are arranged opposite to one another in the side regions of the pre-nozzle 10*c* to form a jacket of the pre-nozzle. The front view of the pre-nozzle 10*c* in FIG. 7 shows that the two rectilinear sections 37, 38 lie at the height of the axis of rotation 18 of the pre-nozzle 10*c* and thus interconnect a lower and an upper arcuate section 39, 40. The two arcuate sections 39, 40 as shown in FIG. 7 are semicircles or semicircular arc sections. The arcuate sections 39, 40 could, however, also have a different shape, for example, an elliptical configuration.

As in the pre-nozzles 10*a* and 10*b*, a water inlet opening area 19 is also obtained in the pre-nozzle 10*c* whose height or length in the vertical direction is greater than the width or length in the horizontal direction.

The two rectilinear sections 37, 38 which can be identified in the cross-sectional view are constant over the entire length of the pre-nozzle 10*c* as shown in FIG. 9. However, it would also be possible to form these rectilinear sections 37, 38 along the pre-nozzle 10*c*, for example from the water inlet opening 12 to the water outlet section 13, as wedge-shaped or otherwise. Accordingly, the cross-section of the rectilinear sections 37, 38 which is rectangular and constant in the present example, would vary along the pre-nozzle 10*c*. For example, the rectangular cross-sectional area could decrease when viewed from front to back. It would also be feasible for the rectilinear sections 37, 38 to taper which means that the cross-sectional area 34 of the pre-nozzle 10*c* would not have any rectilinear sections 37, 38 in the area of the water outlet opening 13.

What is claimed is:

1. A pre-nozzle for a drive system of a watercraft, comprising:

a water inlet opening;

a water outlet opening; and a fin system disposed inside the pre-nozzle, such that the fin system is not arranged in the inlet region of the pre-nozzle, and wherein no propeller is disposed inside the pre-nozzle;

characterized in that the pre-nozzle is configured to be rotationally asymmetrical.

2. The pre-nozzle according to claim 1, characterized in that the water inlet opening of the pre-nozzle is expanded downwards and/or upwards to improve the water inflow.

3. The pre-nozzle according to claims 1 or 2, characterized in that opening areas of the water inlet opening and the water outlet opening of the pre-nozzle are each enclosed by a front-end edge of a nozzle body of the pre-nozzle, wherein at least one of the two enclosed opening areas has a greater length between an upper profile line and a lower profile line than in the horizontal direction.

4. The pre-nozzle according to claim 3, characterized in that the water inlet opening area of the pre-nozzle is greater than a water inlet opening area of a rotationally symmetrical pre-nozzle having the same central radius.

5. The pre-nozzle according to claim 3, characterized in that the pre-nozzle at least partially encloses a propeller axis of the watercraft.

6. The pre-nozzle according to claim 1, characterized in that the opening areas of the water inlet opening and the water outlet opening of the pre-nozzle are at least partially not parallel to one another.

7. The pre-nozzle according to claim 1, characterized in that the pre-nozzle has a profile length, wherein the profile length is not constant and wherein in an upper region of the pre-nozzle, and preferably in the area of the axis of rotation, the profile length is greater than in a lower region of the pre-nozzle.

8. The pre-nozzle according to claim 7, characterized in that the profile length of the pre-nozzle decreases continuously within at least one region, preferably in the lower region, when viewed from top to bottom.

9. The pre-nozzle according to claims 1 or 2, characterized in that opening areas of the water inlet opening and the water outlet opening of the pre-nozzle are each enclosed by a front-end edge of a nozzle body of the pre-nozzle, wherein the water inlet opening area of the pre-nozzle has at least one angle of intersection to the cross-sectional area of the pre-nozzle.

10. The pre-nozzle according to claim 9, characterized in that the angle of intersection is constant and greater than 0° in at least one region.

11. The pre-nozzle according to claim 9, characterized in that the pre-nozzle has an upper profile angle between the upper profile line and the axis of rotation of the pre-nozzle and/or that the pre-nozzle has a lower profile angle between the axis of rotation and the lower profile line of the pre-nozzle, wherein the opening angle of the pre-nozzle between upper and lower profile line of the pre-nozzle is greater than twice the upper profile angle or greater than twice the lower profile angle.

12. The pre-nozzle according to claim 11, characterized in that the opening angle of the pre-nozzle between upper and lower profile line of the pre-nozzle corresponds to the sum of twice the upper profile angle and the angle of intersection or the sum of twice the lower profile angle and the angle of intersection.

13. The pre-nozzle according to claim 11, characterized in that the lower profile angle is greater than the upper profile angle.

14. The pre-nozzle according to claim 1, characterized in that the water inlet opening area of the pre-nozzle is bent or curved and in particular is formed over at least two planes, which are at an angle to one another, wherein the angle is greater than 90° and smaller than 180°.

15. The pre-nozzle according to claim 1, characterized in that the profile length of the pre-nozzle between an upper and a lower profile line of the pre-nozzle decreases continuously from top to bottom.

16. The pre-nozzle according to claim 9, characterized in that the value of the angle of intersection is constant.

17. The pre-nozzle according to claims 1 or 2, characterized in that the pre-nozzle has a constant profile length, so that the profile length is the same in the entire region of the pre-nozzle.

18. The pre-nozzle according to claims 1 or 2, characterized in that a jacket of the pre-nozzle when viewed in cross-section comprises two rectilinear sections over the entire length of the pre-nozzle.

19. The pre-nozzle according to claim 18, characterized in that the rectilinear sections in a cross-sectional view interconnect two arcuate sections.

20. The pre-nozzle according to claim 18, characterized in that the rectilinear sections are disposed at the side region of the pre-nozzle, opposite one another.

21. The pre-nozzle according to claims 1 or 2, characterized in that the ratio of the greatest length of at least one opening area of the pre-nozzle in the vertical direction to the average profile length of the pre-nozzle is between 1.5:1 and 4:1.

* * * * *